United States Patent [19]

Grzina

[11] Patent Number: 4,844,693

[45] Date of Patent: Jul. 4, 1989

[54] LOW-FLOW PUMP CASING

[75] Inventor: Anthony Grzina, Artarmon, Australia

[73] Assignee: Warman International Ltd., Artarmon, Australia

[21] Appl. No.: 115,546

[22] PCT Filed: Apr. 18, 1985

[86] PCT No.: PCT/AU85/00084

§ 371 Date: Dec. 18, 1985

§ 102(e) Date: Dec. 18, 1985

[87] PCT Pub. No.: WO85/04932

PCT Pub. Date: Nov. 7, 1985

Related U.S. Application Data

[63] Continuation-in-part of Ser. No. 827,934, Dec. 18, 1985, abandoned.

[30] Foreign Application Priority Data

Apr. 18, 1984 [AU] Australia ..... PG 4632

[51] Int. Cl.[4] ..... F04D 29/42; F04D 29/00

[52] U.S. Cl. ..... 415/197; 415/206

[58] Field of Search ..... 415/196, 197, 206, 219 B, 415/219 C, 219 A, 203, 207

[56] References Cited

U.S. PATENT DOCUMENTS

| | | | |
|---|---|---|---|
| 169,736 | 2/1899 | Edwards | 415/206 |
| 1,914,919 | 6/1933 | Heermans | 415/219 B |
| 2,144,417 | 1/1939 | Schneible | 415/206 |
| 3,048,117 | 8/1962 | Franzen et al. | 415/219 B |
| 3,051,312 | 8/1962 | Arge | 415/219 B |
| 4,113,407 | 9/1978 | Grzina | 415/197 X |

FOREIGN PATENT DOCUMENTS

| | | | |
|---|---|---|---|
| 25012 | 2/1930 | Australia . | |
| 207990 | 8/1959 | Fed. Rep. of Germany | 415/219 B |
| 57-153990 | 9/1982 | Japan . | |
| 58-122394 | 7/1983 | Japan . | |
| 169173 | 10/1932 | Switzerland | 415/219 B |
| 821755 | 4/1981 | U.S.S.R. . | |
| 2060776 | 5/1981 | United Kingdom . | |

*Primary Examiner*—Robert E. Garrett
*Assistant Examiner*—Joseph M. Pitko
*Attorney, Agent, or Firm*—Amster, Rothstein & Ebenstein

[57] ABSTRACT

A centrifugal slurry pump casing which reduces localized wear behind the cutwater caused when the pump operates at less than the best efficiency point flow rate. By reducing the throat area (13) of the casing (12) in the region of the cutwater (14) to 30–70% of the discharge neck (17) at the discharge flange (18), recirculation and vortexing due to slurry re-entering the volute is substantially reduced.

12 Claims, 3 Drawing Sheets

FIG. 3
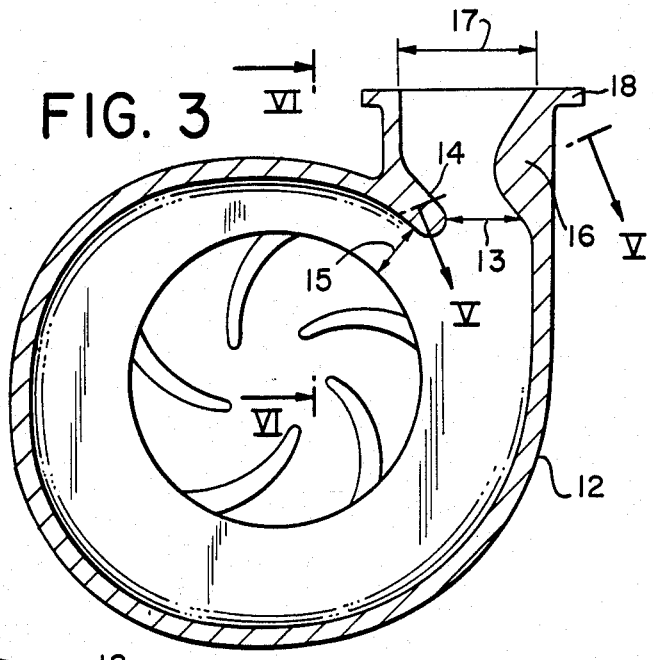
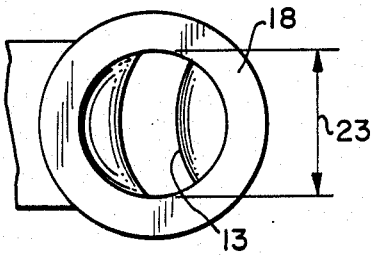
FIG. 4
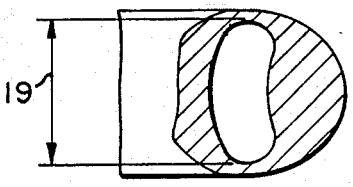
FIG. 5
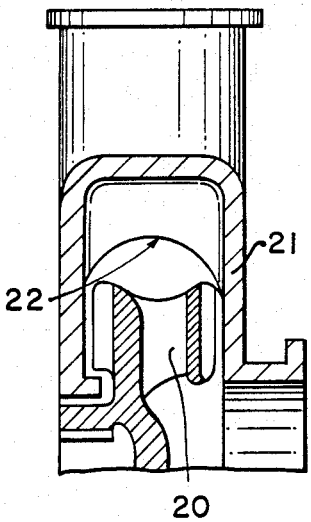
FIG. 6

LOW-FLOW PUMP CASING

This is a continuation-in-part of co-pending application Ser. No. 827,934 filed on Dec. 18, 1985, now abandoned.

This present invention relates to an improved hydraulic shape for a casing or liner design for use with centrifugal pumps, and in particular, pumps handling abrasive solids in suspension (i.e. slurry), where the flowrate is significantly less than the best efficiency point flowrate for that pump.

The casing of a centrifugal pump acts as a collector, containing the fluid as it flows from the impeller, diffusing the high velocities and channeling the fluid into the outlet or discharge branch.

Pumps which are designed for handling non abrasive or clear fluids generally have close clearances between the impeller and the casing at the cutwater (of the order of 2–5% of the impeller diameter), as this gives the most efficient design.

Conversely centrifugal pumps designed to handle fibrous or particulate abrasive solids in suspension (slurry pumps) generally have much larger clearances between the impeller and casing to obviate blockages and high local wear which would occur in the case of small clearances. In addition conventional slurry pump casings have generally a constant area discharge neck, with the cross sectional area at the cutwater only 10–20% less than the area at the discharge flange. Designs incorporating large cutwater clearances and constant area discharge necks give adequate overall performance at the pump "Best Efficiency Point" flowrate (BEP).

However at flowrates less than the BEP sever localised abrasive wear behind the cutwater can be a problem. This wear is caused by recirculation and vortexing as fluid which cannot flow out the discharge branch re-enters the volute flowing around the cutwater at an unfavourable angle. Slurry pumps often have to operate at off-design conditions (i.e flowrates not coincident with the BEP) due to process flow variations or mismatching of the pump and duty requirements.

The present invention seeks to ameliorate the above problems by providing a pump casing for slurry pumps which has an improved casing shape in the region of the cutwater and discharge branch, to minimise the localised wear by changing the conventional flow pattern to suit the reduced pump flowrate.

In one broad form the invention comprises a centrifugal slurry pump casing or liner comprising a discharge throat whose area is reduced compared to the area of the discharge throat of the pump operating at the best efficiency point flowrate.

In another form the invention comprises a centrifugal slurry pump casing adapted to be operated at flowrate in the range of 30–70% of the best efficiency point flowrate, said pump casing shape or liner having an extended cutwater which reduces the throat area of the casing to 30–70% of the discharge neck area at the discharge flange.

Further the present invention provides a liner which can be inserted into a centrifugal pump so as to improve the hydraulic shape in the region of the cutwater and discharge branch, to minimise the localised wear by changing the conventional flow pattern to suit reduced pump flowrates.

A preferred embodiment of the present invention comprises a centrifugal slurry pump casing with the cutwater projecting across and partially obstructing the discharge neck so as to give a reduced area for the discharge. Downstream of the cutwater (i.e. further up the discharge neck) and on the opposite side from the cutwater is a bulge or convex protrusion which acts to further guide the flow and reduce the discharge area. The area reduction is primarily in a plane perpendicular to the axis of impeller rotation, so that the width of the discharge neck remains essentially constant from the cutwater to the discharge flange. The overall shape is such that the effective area of the discharge neck at the cutwater (the throat area) is reduced in the order of 30–70% of the area of the discharge neck at the discharge flange.

The invention does not greatly effect the overall pump hydraulic performance and although the BEP flowrate may be reduced slightly, the pump's head-flow characteristic remains basically unchanged. This greatly enhances the application of the present invention.

As is common with centrifugal pumps when used in the pumping of abrasive media, the casing is made from either hard metal or elastomeric material, and while the casing or liner may be spilt in 2 or 3 pieces to aid in assembly, or may even be only the containment vessel for a pump with outer covering plate, the primary aspect of the invention relates to the internal hydraulic shape not the outer form, material or method of support for the casing or liner.

The invention will now be described by way of example with reference to the accompanying figures, in which:

FIG. 3 is a cross-section of a centrifugal slurry pump impeller and casing according to an embodiment of the present invention, said cross-section being in a plane normal to the axis of impeller rotation;

FIG. 4 shows a view of the casing flange and throat of FIG. 3;

FIG. 5 shows a section through the casing of FIG. 3 at v—v; and

FIG. 6 is a partial cross-section of a casing according to this invention, said cross-section being in a plane through the axis of impeller rotation.

Figure 1:
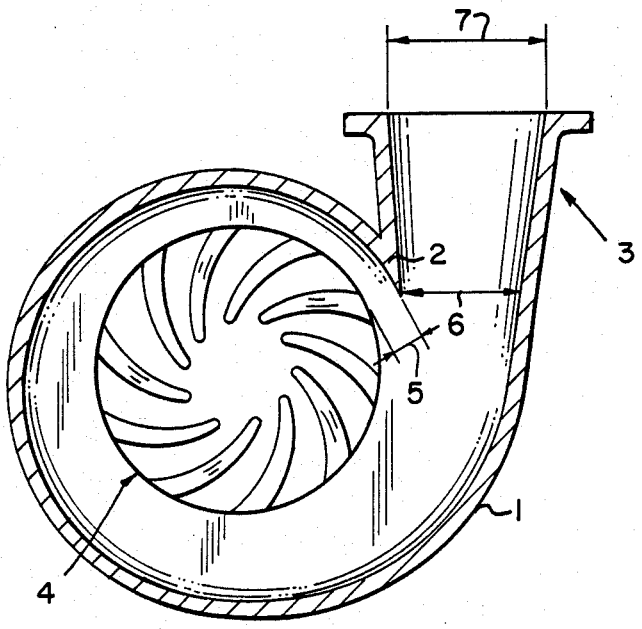
FIG. 1 is a cross-section of a conventional centrifugal water pump impeller and casing, said cross-section being in a plane normal to the axis of impeller rotation.

Referring to FIG. 1, the typical centrifugal pump casing (1) has a gradually increasing radius of curvature starting from the cutwater (2) through to a point tangential to the discharge neck (3). The impeller 4 spins within the casing having a smallest peripheral clearance at the cutwater (5). The discharge neck area generally increases from the throat (6) adjacent to the cutwater through to the discharge flange (7).

Figure 2:
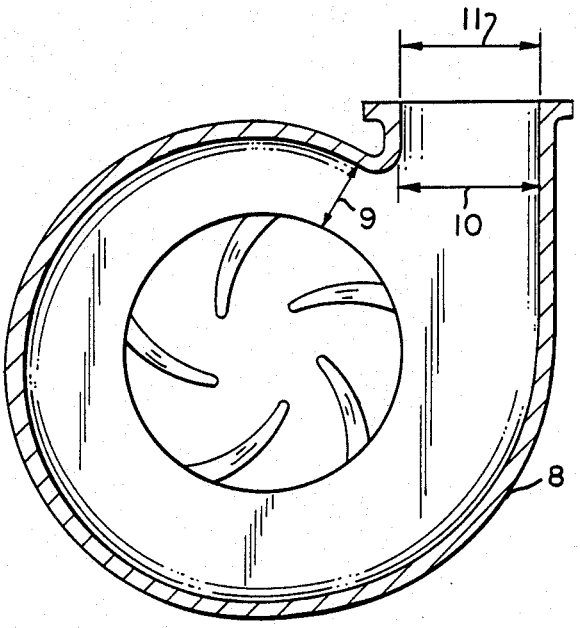
FIG. 2 is a cross-section of a conventional centrifugal slurry pump impeller and casing, said cross-section being in a plane normal to the axis of impeller rotation.

The above described water pump casing (1) can be compared with a conventional slurry pump casing (8) in FIG. 2. The main differences are readily apparent, with the increased cutwater clearance (9), and fairly uniform discharge neck area between the throat (10) and discharge flange (11) being the most obvious. It can be seen that this design would readily allow flow recirculation around the cutwater at reduced flowrates (w.r.t. BEP) because of the open throat area and shape of the cutwater.

FIG. 3 illustrates the preferred embodiment of a slurry pump casing of the present invention which comprises a basically conventional slurry pump casing (12) with an unconventional shape in the cutwater area. To reduce the throat area (13) and stop recirculation the cutwater (14) is extended across the throat without greatly altering the cutwater clearance (15) and a protrusion roughly convex in shape (16) is added to the opposing wall of the discharge neck. The resultant geometry leads to a reduction in the throat area such that the ratio of throat area (13) to discharge area (17) is in the range 0.3 to 0.7. The cutwater clearance (15) is in the range of between 5 and 40% of the impeller diameter, depending on the individual design requirements.

FIG. 5 shows a section taken at a plane normal to the discharge neck centreline as indicated in FIG. 3. As can be seen the width 23 at the discharge flange (18) is approximately the same as the width at the throat (19). However the width of the throat can be between 50% and 100% of the width of the discharge flange.

FIG. 6 shows a half section view vi—vi taken through the axis of the impeller centreline as indicated in FIG. 3. This view illustrates the relationship between the impeller (20) and the pump casing (21). The improved cutwater profile (22) is shown with its fillet radii blending continuously at the apex of the cutwater and the casing side walls.

Figure 7:
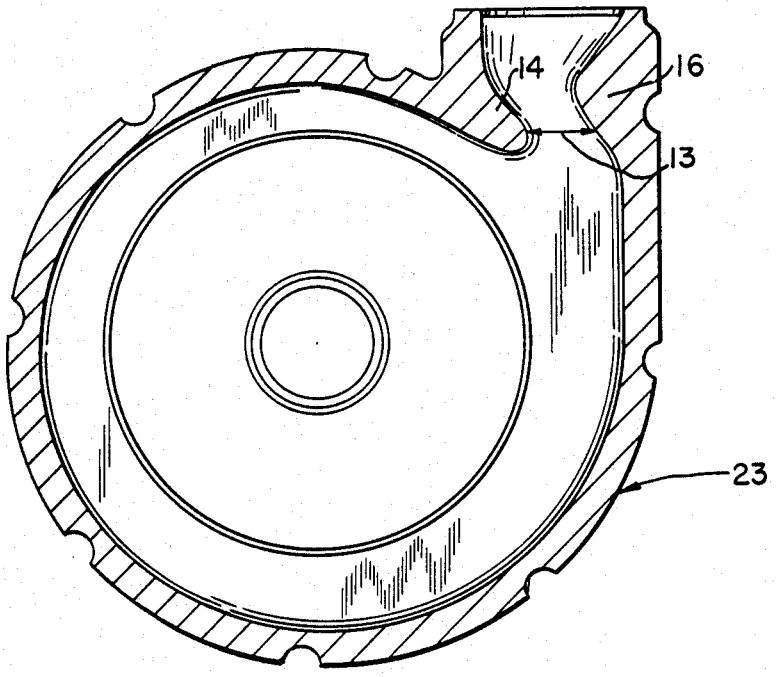
FIG. 7 shows one half of an elastomeric liner according to one embodiment of the present invention.

The present invention also relates to the use of a liner to alter the throat area of a pump to minimise local wear caused by reduced pump flowrates. As shown in FIG. 7, the frame plate half 23 of an elastomeric liner illustrates the extended cutwater 14 and protrusion 16 causing reduced throat area 13.

To form the total liner, the frame plate liner 23 is joined to the cover plate liner half (not shown) and clamped within the pump casing (not shown) to alter the hydraulic shape of the casing.

While this invention has been described in connection with the preferred embodiment, it is understood that various modifications may be made without departing from the spirit of the invention.

I claim:

1. A centrifugal slurry pump casing adapted to be operated at a flowrate in the range of 30–70% of the best efficiency point flowrate, said pump casing internal shape defining a throat area defining a discharge neck and having an extended cutwater and a convex shaped protrusion in the discharge neck opposite to and slightly downstream from the cutwater, said protrusion and cutwater reducing the throat area of the casing to 30–70% of the discharge neck area at the discharge flange.

2. A pump casing as defined in claim 1 having an impeller located therein with the cutwater having a clearance from the impeller of between 5 to 40%.

3. A centrifugal slurry pump casing adapted to be operated at a flowrate in the range of 30–70% of the best efficiency point flowrate, said pump casing shape defining a throat area defining a discharge neck and having an extended cutwater, a convex shaped protrusion in the discharge neck opposite to and slightly downstream from the cutwater, and a concave shaped indentation in the discharge neck opposite to said protrusion, said protrusion and cutwater reducing the throat area of the casing to 30–70% of the discharge neck area at the discharge flange.

4. A pump casing as defined in claim 3 having an impeller located therein with the cutwater having a clearance from the impeller of between 5 to 40%.

5. A liner for a centrifugal slurry pump adapted to be operated at a flowrate in the range of 30–70% of the best efficiency point flowrate, said liner defining a throat area defining a discharge neck and having an internal shape having a cutwater extending into the throat area and a convex shaped protrusion in the discharge neck opposite to and slightly downstream from the cutwater, said protrusion and cutwater cooperating to reduce the throat area of the liner to 30–70% of the discharge neck area at the discharge flange.

6. A liner as defined in claim 5 having an impeller located therein with the cutwater having a radial clearance from the impeller of between 5 to 40% of the impeller diameter.

7. A liner as defined in claim 6 wherein said liner is made of elasotomeric material.

8. A liner as defined in claim 5 wherein said liner is made of elasotomeric material.

9. A liner for a centrifugal slurry pump casing adapted to be operated at a flowrate in the range of 30–70% of the best efficiency point flowrate, said liner defining a throat area defining a discharge neck and having an internal shape having a cutwater extending into the throat area, a convex shaped protrusion in the discharge neck opposite to and slightly downstream from the cutwater, and a concave shaped indentation in the discharge neck directly opposite to said protrusion, said protrusion and cutwater cooperating to reduce the throat area of the liner to 30–70% of the discharge neck area at the discharge flange.

10. A liner as defined in claim 9 having an impeller located therein with the cutwater having a radial clearance from the impeller of between 5 to 40% of the impeller diameter.

11. A liner as defined in claim 10 wherein said liner is made of elasotomeric material.

12. A liner as defined in claim 9 wherein said liner is made of elasotomeric material.

* * * * *

UNITED STATES PATENT AND TRADEMARK OFFICE

CERTIFICATE OF CORRECTION

PATENT NO. : 4,844,693

DATED : July 4, 1989

INVENTOR(S) : Anthony Grzina

It is certified that error appears in the above-identified patent and that said Letters Patent is hereby corrected as shown below:

Abstract page, item 22 should read --
[22] Filed Oct. 28, 1987--;
delete items 86 and 87;
item 63 should read --
[63] Continuation-in-part of Ser. No. 827,934, filed as PCT/AU85/00084 on April 18, 1985, published as WO85/04932 on November 7, 1985, abandoned.

Signed and Sealed this

Twenty-sixth Day of June, 1990

*Attest:*

HARRY F. MANBECK, JR.

*Attesting Officer*

*Commissioner of Patents and Trademarks*